US010413041B2

(12) United States Patent
Yoo

(10) Patent No.: US 10,413,041 B2
(45) Date of Patent: Sep. 17, 2019

(54) TWO-LIQUID MIXING CONTAINER PROVIDED WITH PRESSING POCKET

(71) Applicant: AMOREPACIFIC CORPORATION, Seoul (KR)

(72) Inventor: Chang Gyu Yoo, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 124 days.

(21) Appl. No.: 15/525,035

(22) PCT Filed: Nov. 6, 2015

(86) PCT No.: PCT/KR2015/011880
§ 371 (c)(1),
(2) Date: May 5, 2017

(87) PCT Pub. No.: WO2016/080685
PCT Pub. Date: May 26, 2016

(65) Prior Publication Data

US 2018/0279743 A1 Oct. 4, 2018

(30) Foreign Application Priority Data

Nov. 20, 2014 (KR) ..... 20-2014-0008525 U

(51) Int. Cl.
*A45D 40/24* (2006.01)
*A45D 34/00* (2006.01)
(Continued)

(52) U.S. Cl.
CPC ..... *A45D 40/24* (2013.01); *A45D 34/00* (2013.01); *A45D 34/04* (2013.01);
(Continued)

(58) Field of Classification Search
CPC ..... A45D 40/24; A45D 34/04; A45D 34/00; A45D 2200/058; B65D 81/3255; B65D 81/32; B05B 11/0081
See application file for complete search history.

(56) References Cited

U.S. PATENT DOCUMENTS 2,518,145 A * 8/1950 Jenson ..... B67D 3/00 222/214
3,998,359 A * 12/1976 Pettit ..... B64G 1/50 222/3
(Continued)

FOREIGN PATENT DOCUMENTS

KR 20-0362397 Y1 9/2004
KR 10-2012-0140563 A 12/2012
(Continued)

*Primary Examiner* — David P Angwin
*Assistant Examiner* — Bob Zadeh
(74) *Attorney, Agent, or Firm* — Heedong Chae; Lucem, PC

(57) ABSTRACT

The present device pertains to a two-liquid mixing container provided with a pressing pocket, and more particularly, to a two-liquid mixing container provided with a pressing pocket wherein a cosmetic container comprises a container body, a discharge pump, a pressing button and a container lid, and wherein a first cosmetic content is received inside the container body, a lower cap is detachably coupled to the lower part of the container body, and a pressing pocket having a second cosmetic content filled therein is coupled to the inside of the lower cap such that after a user separates the lower cap from the container body and then upwardly presses the pressing pocket, thereby mixing the first cosmetic content and the second cosmetic content, the mixed cosmetic content is exhausted by the discharge pump and used. Accordingly, since the structure of the container is simple, the productivity thereof is improved.

10 Claims, 12 Drawing Sheets

(51) Int. Cl.

| | |
|---|---|
| ***B65D 81/32*** | (2006.01) |
| ***B05B 11/00*** | (2006.01) |
| ***A45D 34/04*** | (2006.01) |

(52) U.S. Cl.

CPC ..... *B05B 11/0081* (2013.01); *B65D 81/32* (2013.01); *B65D 81/3255* (2013.01); *A45D 2200/058* (2013.01)

(56) References Cited

U.S. PATENT DOCUMENTS

| | | | | |
|---|---|---|---|---|
| 4,014,463 | A * | 3/1977 | Hermann | B05C 17/00513 222/135 |
| 5,637,087 | A * | 6/1997 | O'Neil | A61M 5/282 604/82 |
| 7,431,181 | B2 * | 10/2008 | Masuda | B05B 11/007 222/256 |
| 7,497,354 | B2 * | 3/2009 | Decottignies | B05B 11/3084 222/135 |
| 8,672,186 | B2 * | 3/2014 | Geiberger | B05B 11/3085 222/135 |
| 2006/0054634 | A1 * | 3/2006 | Mekata | B05B 11/3081 222/94 |

FOREIGN PATENT DOCUMENTS

| | | | |
|---|---|---|---|
| KR | 20-0472282 | Y1 | 4/2014 |
| KR | 10-1430988 | B1 | 8/2014 |
| KR | 10-1431518 | B1 | 8/2014 |

* cited by examiner

TWO-LIQUID MIXING CONTAINER PROVIDED WITH PRESSING POCKET

CROSS-REFERENCE TO RELATED APPLICATION

This application claims the benefit of Korean application No. 20-2014-0008525, filed on Nov. 20, 2014 with the Korean Intellectual Property Office, the disclosure of which is incorporated herein by reference.

TECHNICAL FIELD

The present device pertains to a two-liquid mixing container provided with a pressing pocket, and more particularly, to a two-liquid mixing container provided with a pressing pocket wherein a cosmetic container comprises a container body, a discharge pump, a pressing button and a container lid, and wherein a first cosmetic content is received inside the container body, a lower cap is detachably coupled to the lower part of the container body, and a pressing pocket having a second cosmetic content filled therein is coupled to the inside of the lower cap such that after a user separates the lower cap from the container body and then upwardly presses the pressing pocket, thereby mixing the first cosmetic content and the second cosmetic content, the mixed cosmetic content is exhausted by the discharge pump and used. Accordingly, since the structure of the container is simple, the productivity thereof is improved.

BACKGROUND ART

Cosmetics refer to goods which are used for a human body in order to add charming of the human body and change the appearance of the human body to be brighter, or to maintain or enhance skin or hair in a healthy state by making the human body clean and beautiful, and have a minor effect on the human body.

In recent years, the trend of cosmetics is toward functional cosmetics that nourish skin while protecting the skin beyond the sample cosmetic usage.

The functional cosmetics are products that help to whiten the skin, help to improve the wrinkles of the skin, protect the skin from ultraviolet rays, and include sunscreen, wrinkle-improving nutrition cream, whitening essence, and the like.

Recently, various kinds of cosmetics have been developed depending on their use and features as they have focused on functionality. Specifically, attempts have been made to incorporate functional cosmetic materials containing vitamins, other bioactive cosmetic ingredients and the like into a base cosmetic material.

However, since the functional cosmetic material may be very unstable and easily be spoiled, it is difficult to store the functional cosmetic material contained in a base cosmetic for a long time.

To solve the problems described above, as shown in FIG. 1, a product has been disclosed in Korean Registered Utility Model No. 20-0270335, where an inner container 2 is formed on a low portion of an outer container 1 in a diagonal shape. When both the containers are coupled to each other, a pointed portion of the inner container 2 having a diagonal shape breaks a sealing cap 3 to mix a base cosmetic material filled in the outer container 1 and the functional cosmetic material filled in the inner container 2, so that different cosmetic materials are easily mixed with each other through a simple operation for use.

However, according to the related art, since two kinds of cosmetic materials are mixed by destroying the sealing cap 3, the destroyed and separated sealing cap 3 may be introduced into a discharge tube of the outer container 1, thereby interrupting the discharge of cosmetic contents. In addition, the cosmetic materials filled in the outer container 1 may be contaminated by the destroyed sealing cap 3.

DISCLOSURE

Technical Problem

To solve the problems described above, an object of the present invention is to provide a two-liquid mixing container provided with a pressing pocket, wherein a first cosmetic content is received inside a container body, a lower cap is detachably coupled to a lower part of the container body, and the pressing pocket filled with a second cosmetic content is coupled to an inside of the lower cap, such that, after a user separates the lower cap from the container body and then upwardly presses the pressing pocket, thereby mixing the first cosmetic content and the second cosmetic content, the mixed cosmetic content is exhausted by the discharge pump for use.

In addition, another object of the present invention is to provide a two-liquid mixing container provided with a pressing pocket, wherein the pressing pocket is formed in a bellows shape, an elastic member is mounted on an outside of the pressing pocket, and a push plate is formed on the bottom of a lower cap. Thus, when a user pushes up the push plate without separating the lower cap, first and second cosmetic contents are mixed with each other, so that the user may conveniently use cosmetics.

In addition, still another object of the present invention is to provide a two-liquid mixing container provided with a pressing pocket, of which the structure is simple so that the two-liquid mixing container may be easily mass-produced, thereby reducing the manufacturing cost and the number of assembly processes airflow, and improving the productivity.

Technical Solution

According to the present invention, there is provided a two-liquid mixing container provided with a pressing pocket, which includes a container body (10) containing a first cosmetic content and having upper and lower parts opened;

a pressing pocket (20) coupled to the lower part of the container body (10) to contain a second cosmetic content;

a lower cap (30) covering an outside of the pressing pocket (20) and detachably attached to the lower part of the container body (10);

a shoulder (40) coupled to the upper part of the container body (10);

a discharge pump (50) installed inside the shoulder (40) to pump cosmetic contents;

an upper cap (60) coupled to an outer peripheral surface of the shoulder (40);

a push button (70) installed to an upper end of the discharge pump (50) and formed on one side thereof with a discharge nozzle (71); and a container lid (80) detachably attached to the shoulder (40).

In addition, the two-liquid mixing container may further include first and second fixing members (11 and 12) coupled to the lower part of the container body (10) for fixing the pressing pocket (20).

In addition, the two-liquid mixing container may further include a discharge valve (14) installed at a center of an inside of the first fixing member (11) to selectively open or close an outlet (13) for a second cosmetic content.

In addition, the two-liquid mixing container may further include a latch sill (21) formed on an upper end of the pressing pocket (20), wherein the latch sill (21) is fixedly inserted between the first and second fixing members (11 and 12).

In addition, the pressing pocket (20) may be formed of at least one of natural rubber, elastomer, silicone rubber, nitrile-butadiene rubber (NBR), and elastic synthetic material.

In addition, the pressing pocket may be formed in a bellows shape.

In addition, the two-liquid mixing container may further include a push plate (31) movably formed on a bottom of the lower cap (30), a separation protecting protrusion wheel (32) formed on an outer peripheral surface of the push plate (31), and a receiving protrusion wheel (33) extending from an upper part of the separation protecting protrusion wheel (32).

In addition, the two-liquid mixing container may further include a lower cap elastic member (35) installed between an inner upper end of the lower cap (30) and the receiving protrusion wheel (33) of the push plate (31).

In addition, the discharge pump (50) may include a piston (53), a cylinder (51) into which the piston (53) is inserted, a piston ring (54) installed between n outer peripheral surface of the piston (53) and an inner peripheral surface of the cylinder (51), a check valve (52) formed on a lower part of the cylinder (51), a sealing member (55) coupled to an upper part of the cylinder (51), an elevation member (57) coupled between the sealing member (55) and the piston (53), and an elastic member (56) formed, between the elevation member (57) and the sealing member (55).

In addition, the upper cap (60) may include an inner cap (61) and an outer cap (62), wherein a fixing protrusion wheel (63) is integrally formed with an inside of the inner cap (61) while extending from the inside of the inner cap (61).

Advantageous Effects

According to the two-liquid mixing container provided with a pressing pocket of the present invention, wherein the first cosmetic content is received inside the container body, the lower cap is detachably coupled to the lower part of the container body, and the pressing pocket filled with the second cosmetic content is coupled to the inside of the lower cap, such that, after a user separates the lower cap from the container body and then upwardly presses the pressing pocket, thereby mixing the first cosmetic content and the second cosmetic content, the mixed cosmetic content is exhausted by the discharge pump for use.

In addition, according to the two-liquid mixing container provided with a pressing pocket of the present invention, the pressing pocket is formed in a bellows shape, the elastic member is installed to the outside of the pressing pocket, and the push plate is formed on the bottom of the lower cap. Thus, when a user pushes up the push plate without separating the lower cap, the first and second cosmetic contents are mixed with each other, so that the cosmetics may be conveniently used.

In addition, according to the two-liquid mixing container provided with a pressing pocket of the present invention, the structure of the pressing pocket is simple so that the two-liquid mixing container may be easily mass-produced, thereby reducing the manufacturing cost and the number of assembly processes airflow, and improving the productivity.

BEST MODE

[Mode for Invention]

Hereinafter, a two-liquid mixing container provided with a pressing pocket according to an embodiment of the present invention will be described with reference to accompanying drawings.

Figure 1:
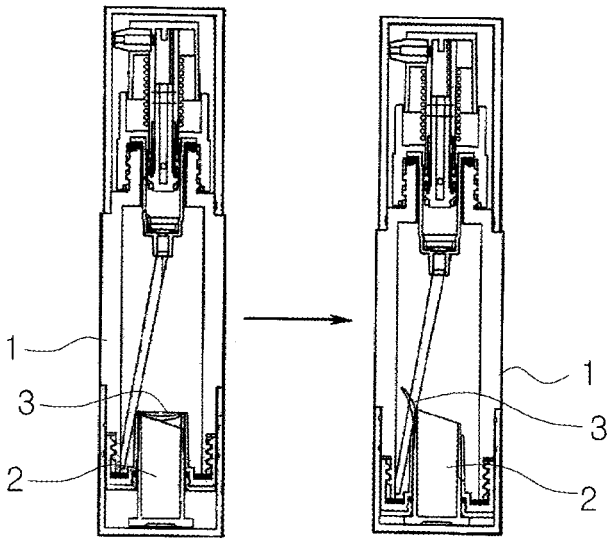
FIG. 1 is a sectional view showing a two-liquid mixing container provided with a pressing pocket according to the related art.
Figure 2:
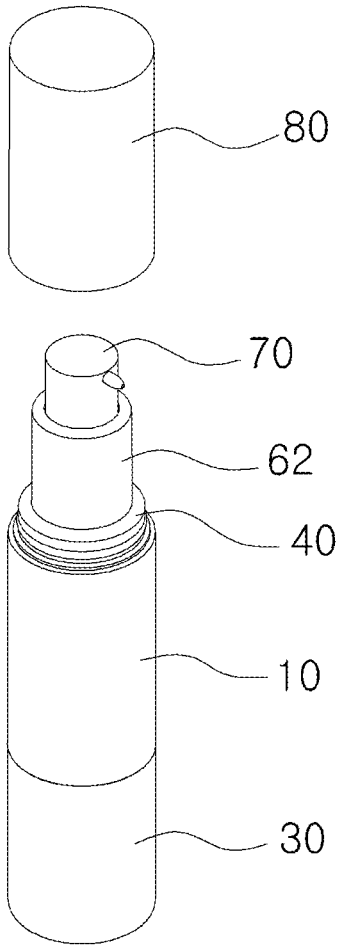
FIG. 2 is a perspective view showing a two-liquid mixing container provided with a pressing pocket according to an embodiment of the present invention.
Figure 3:
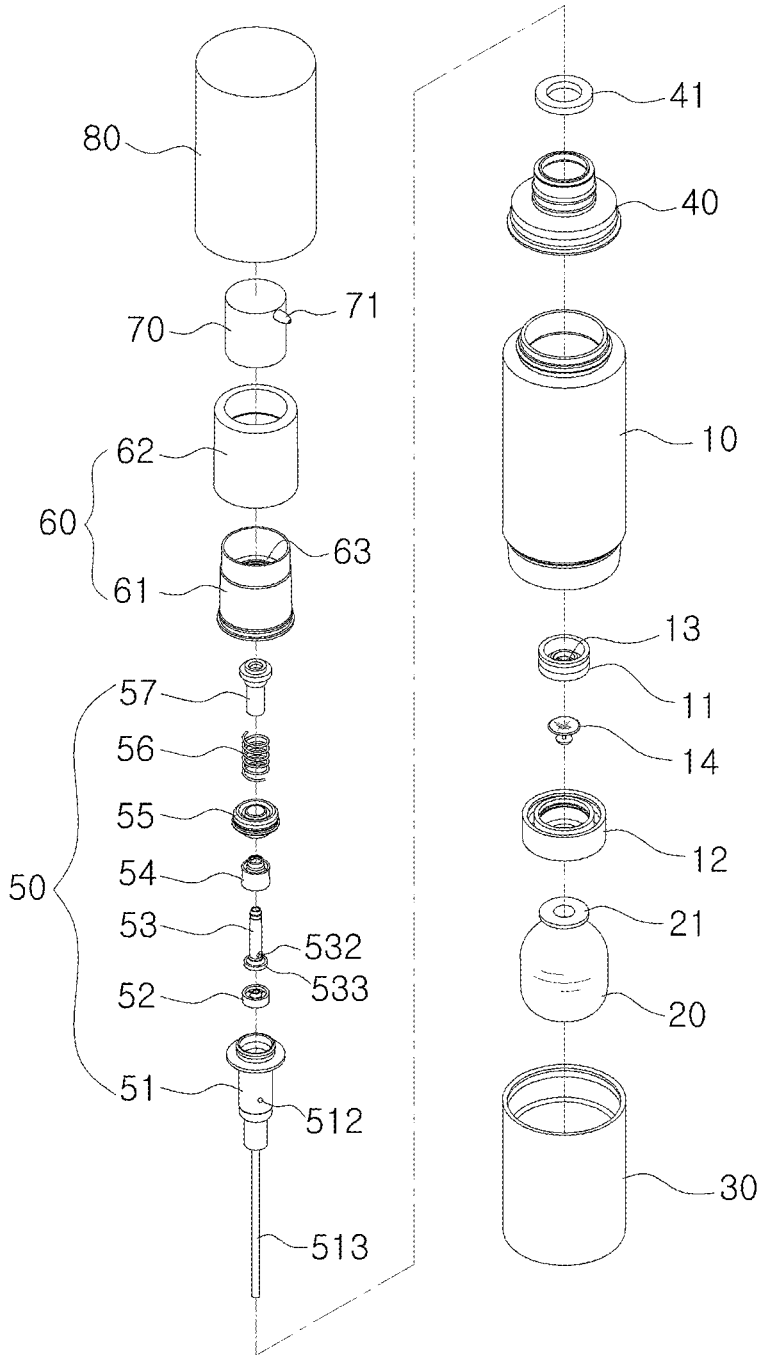
FIG. 3 is an exploded perspective view illustrating a two-liquid mixing container provided with a pressing pocket according to an embodiment of the present invention.
Figure 4:
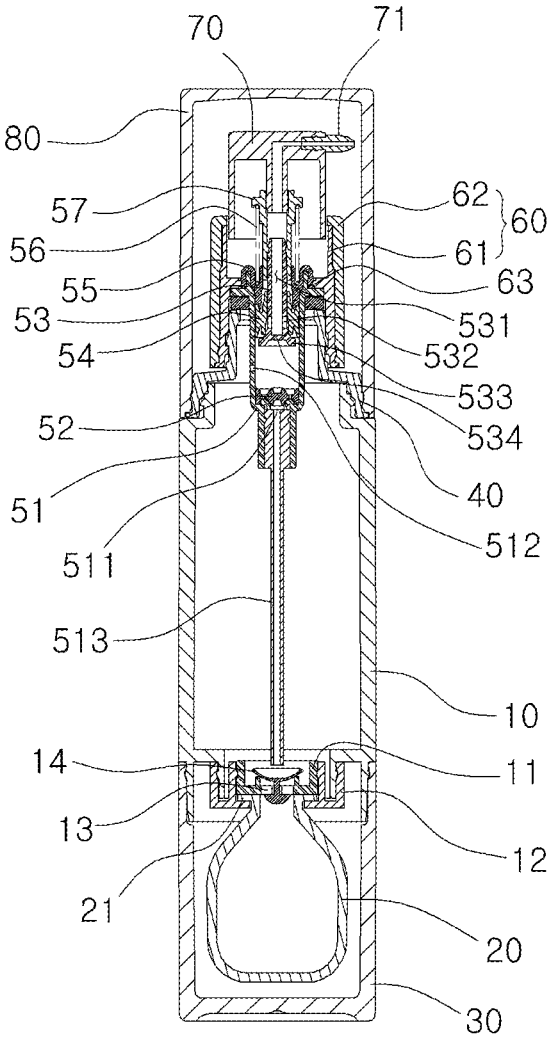
FIG. 4 is a sectional view illustrating a two-liquid mixing container provided with a pressing pocket according to an embodiment of the present invention.
Figure 5:
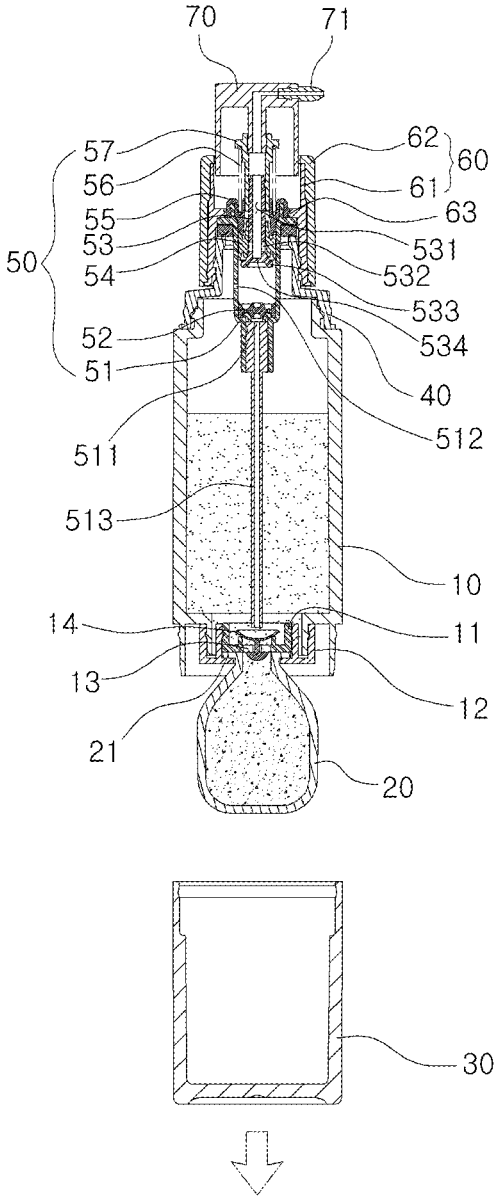
FIG. 5 is a sectional view illustrating a lower cap of a two-liquid mixing container provided with a pressing pocket according to an embodiment of the present invention.
Figure 6:
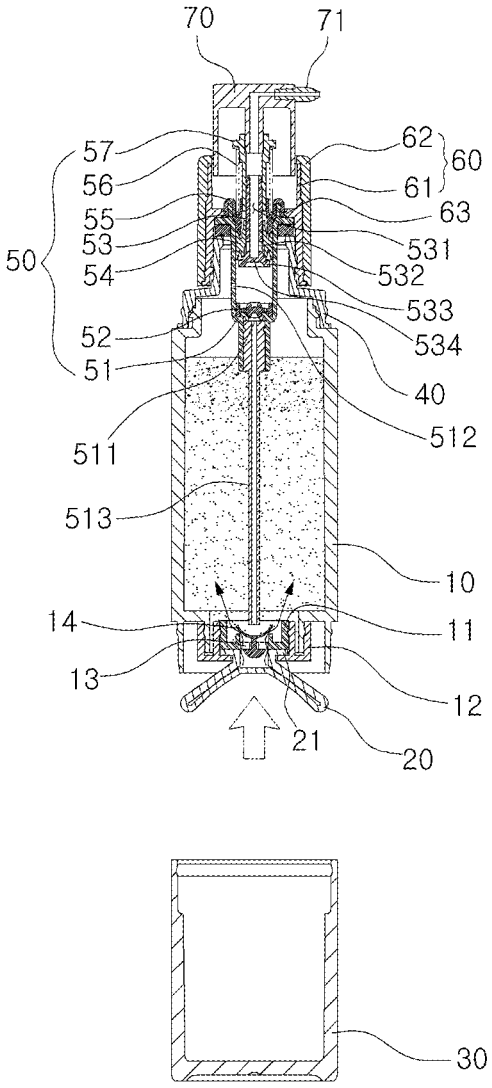
FIG. 6 is a sectional view illustrating a state of pressing a pressing pocket after separating a lower cap of a two-liquid mixing container provided with a pressing pocket according to an embodiment of the present invention.
Figure 7:
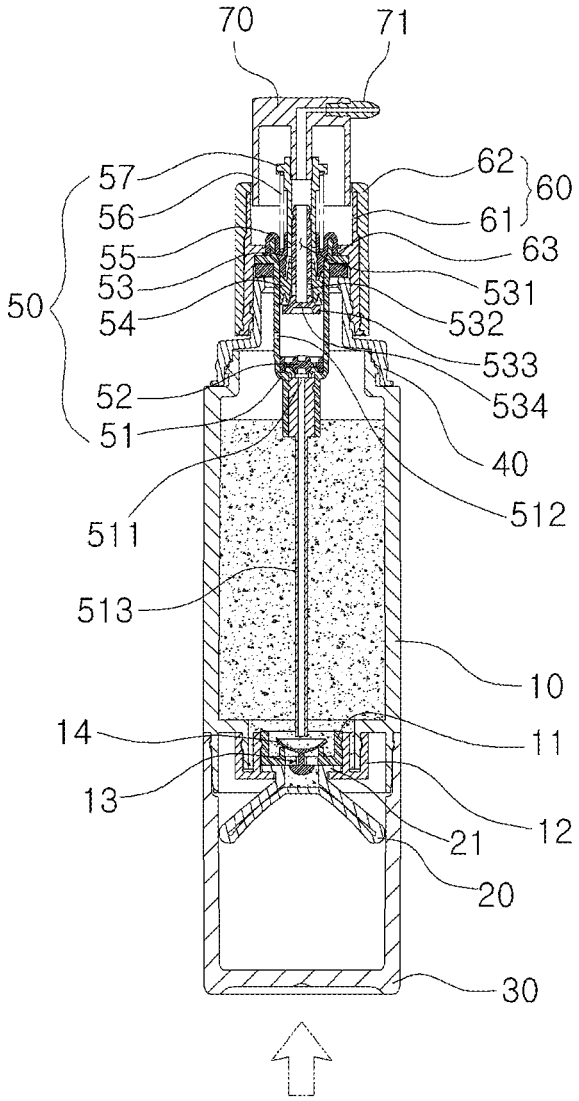
FIG. 7 is a sectional view illustrating a state of coupling a lower cap of a two-liquid mixing container provided with a pressing pocket according to an embodiment of the present invention.
Figure 8:
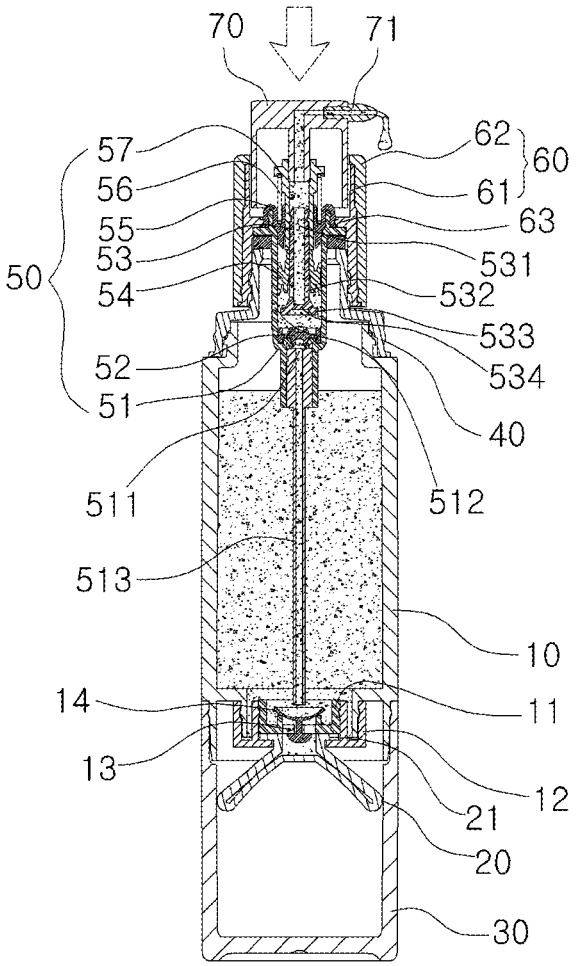
FIG. 8 is a sectional view illustrating a state where a cosmetic content is discharged by pressing a pressing pocket of a two-liquid mixing container provided with a pressing pocket according to an embodiment of the present invention.
Figure 9:
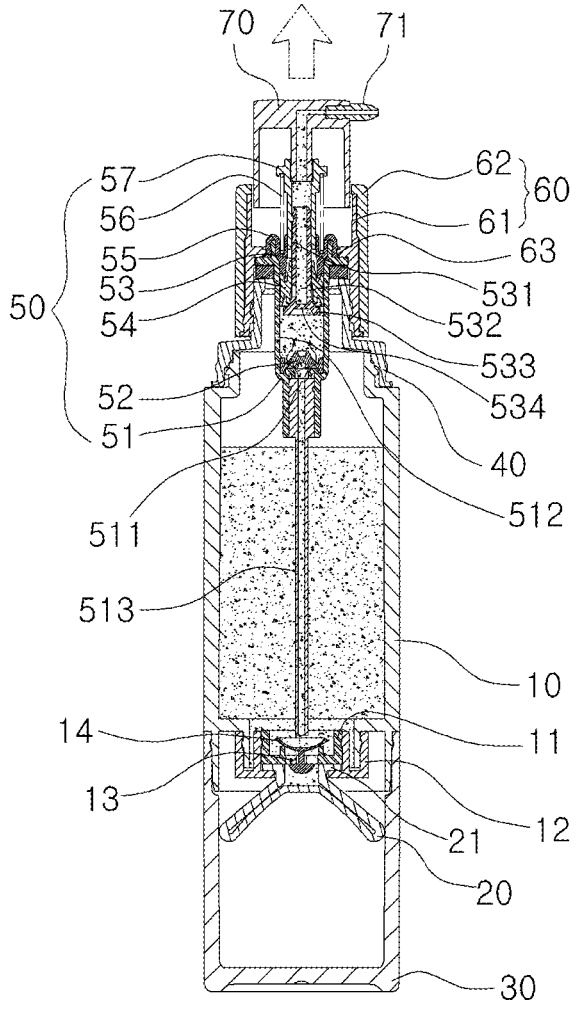
FIG. 9 is a sectional view illustrating a state of releasing a pressure on a push button of a two-liquid mixing container provided with a pressing pocket according to an embodiment of the present invention.

FIG. 2 is a perspective view showing a two-liquid mixing container provided with a pressing pocket according to an embodiment of the present invention. FIG. 3 is an exploded perspective view illustrating a two-liquid mixing container provided with a pressing pocket according to an embodiment of the present invention. FIG. 4 is a sectional view illustrating a two-liquid mixing container provided with a pressing pocket according to an embodiment of the present invention. FIG. 5 is a sectional view illustrating a lower cap of a two-liquid mixing container provided with a pressing pocket according to an embodiment of the present invention. FIG. 6 is a sectional view illustrating a state of pressing a pressing pocket after separating a lower cap of a two-liquid mixing container provided with a pressing pocket according to an embodiment of the present invention. FIG. 7 is a sectional view illustrating a state of coupling a lower cap of a two-liquid mixing container provided with a pressing pocket according to an embodiment of the present invention. FIG. 8 is a sectional view illustrating a state where a cosmetic content is discharged by pressing a pressing pocket of a two-liquid mixing container provided with a pressing pocket according to an embodiment of the present invention. FIG. 9 is a sectional view illustrating a state of releasing a pressure on a push button of a two-liquid mixing container provided with a pressing pocket according to an embodiment of the present invention.

A two-liquid mixing container provided with a pressing pocket according to the present invention includes a container body 10 containing a first cosmetic content and having upper and lower parts opened, a pressing pocket 20 coupled to the lower part of the container body 10 to contain a second cosmetic content, a lower cap 30 covering an outside of the pressing pocket 20 and detachably attached to the lower part, a shoulder 40 coupled to the upper portion of the container body 10, a discharge pump 50 installed inside the shoulder 40 to pump cosmetic contents, an upper cap 60 coupled to an outer peripheral surface of the shoulder 40, a push button 70 installed to an upper end of the discharge pump 50 and formed on one side thereof with a discharge nozzle 71, and a container lid 80 detachably attached to the shoulder 40.

The container 10 contains the first cosmetic content and has a shape having opened upper and lower parts.

First and second fixing members 11 and 12 are coupled to the lower part of the container body 10.

The first fixing member 11 is coupled to an inside of the second fixing member 12, and an outlet 13 for moving the second cosmetic content contained in the pressing pocket 20 to the container body 10 is formed at the center of the first fixing member 11.

A discharge valve 14 is installed at a center of an inside of the first fixing member 11 to selectively open or close the outlet 13.

As shown in FIG. 4, a latch sill 21 formed on the pressing pocket 30 is interposed between the first and second fixing members 11 and 12 to fix the pressing pocket 20 to a lower part of the container body 10.

The pressing pocket 20 is coupled to the lower part of the container body 10 to be filled with the second cosmetic content.

The latch sill 21 is formed on an upper end of the pressing pocket 20, where the latch sill 21 is fixedly interposed between the first and second fixing members 11 and 12.

Preferably, the pressing pocket 20 is formed of at least one of natural rubber, elastomer (TPE), silicone rubber, nitrile-butadiene rubber (NBR), and elastic synthetic rubber to allow the second cosmetic content contained therein to be easily discharged.

Figure 10:
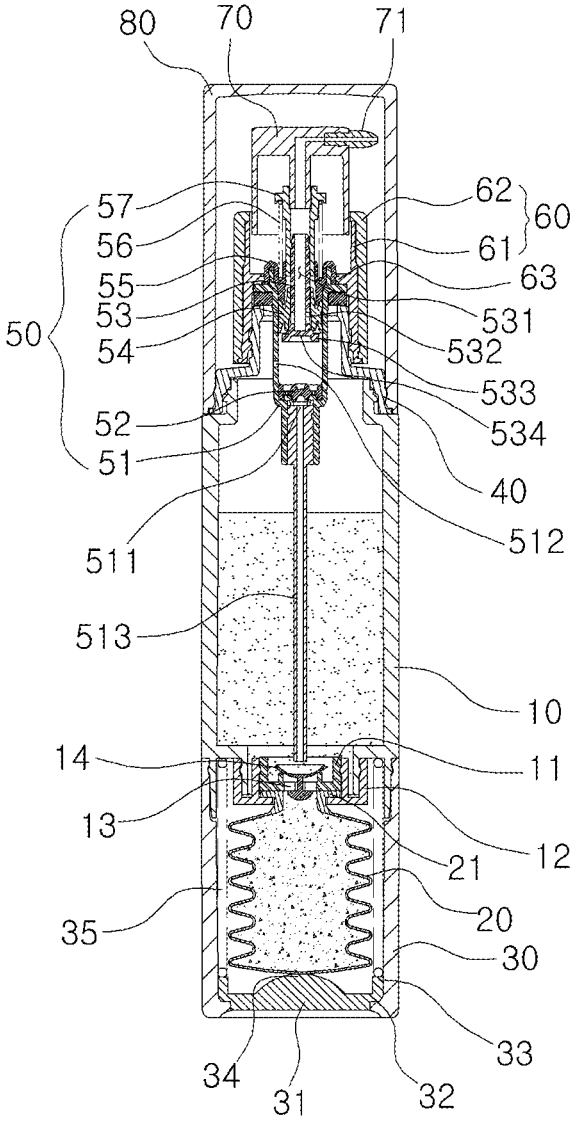
FIG. 10 is a sectional, view showing a two-liquid mixing container provided with a pressing pocket according to another embodiment of the present invention.

As shown in FIG. 10, the pressing pocket 20 may be formed in a bellows shape.

The lower cap 30 is coupled to an outside of the pressing pocket 20 and detachably attached to the lower part of the container body 10.

The lower cap 30 is formed on an inner peripheral surface of an upper part of the lower cap 30 with an undercut or a thread such that the lower cap 30 is undercut or screw coupled to the lower part of the container body 10.

As shown in FIGS. 5 and 6, the lower cap 30 is separated from the lower part of the container body 10 to press the pressing pocket 20.

After the lower cap 30 is separated from the container body 10, the pressing pocket 20 containing the second cosmetic content is pressed to transfer the second cosmetic content to the container body 10.

Figure 11:
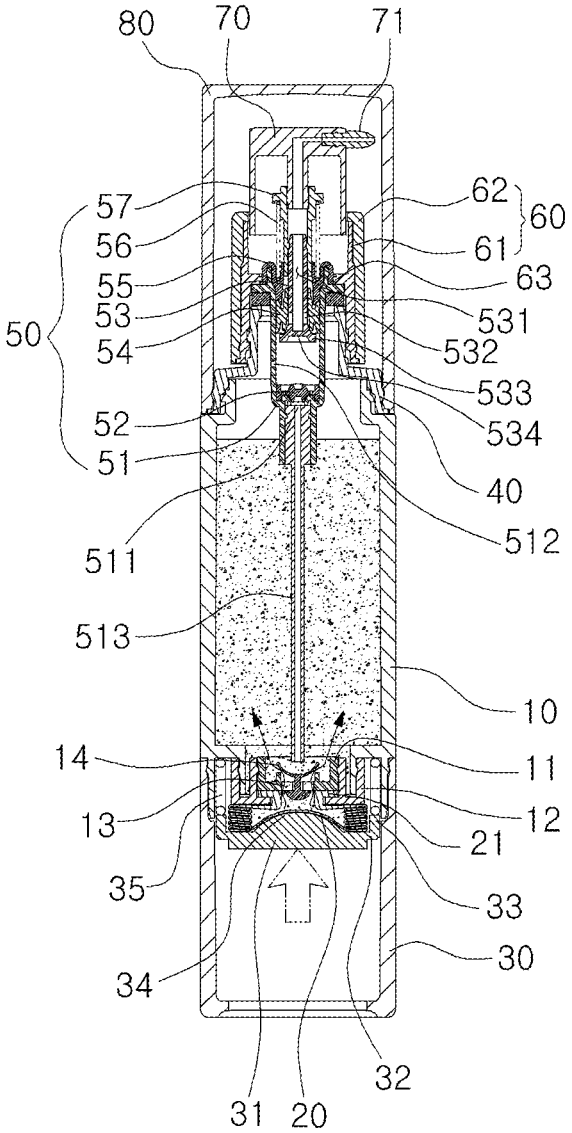
FIG. 11 is a sectional view illustrating a state of pressing a pressing pocket of a two-liquid mixing container provided with a pressing pocket according to another embodiment of the present invention.

In addition, as shown in FIGS. 10 and 11, according another embodiment of the present invention, a lower end of the lower cap 30 may be movably formed to press the pressing pocket 20.

A push plate 31 movable up and down is formed on the bottom of the lower cap 30, a separation protecting protrusion wheel 32 is formed on an outer peripheral surface of the push plate 31, and a receiving protrusion wheel 33 extends from an upper portion of the separation protecting protrusion wheel 32.

As shown in FIG. 11, the push plate 31 presses the pressing pocket 20 and is preferably formed on an upper end thereof with a push part 34 for smooth pushing.

The separation protecting protrusion wheel 32 prevents the push plate 31 from being separated from the lower cap 30.

The receiving protrusion wheel 33, on which the lower end of a lower cap elastic member 35 is placed, stably supports the lower cap elastic member 35.

The lower cap elastic member 35 is installed between an inner upper end of the lower cap 30 and the receiving protrusion wheel 33 of the push plate 31 such that the lower cap elastic member 35 elastically supports the push plate 31.

As described above, since the push plate 31 is formed on the bottom of the lower cap 30, when a user just pushes up the push plate 31 without separating the lower cap 30, the first and second cosmetic contents are mixed, so that the cosmetics may be conveniently used.

A shoulder 40 is coupled to an upper part of the container body 10.

The shoulder 48 may integrally extend from an upper part of the container body 10, or may be separately formed as in the present invention.

The discharge pump 50 is installed to an inside of the shoulder 40 and a gasket 41 is coupled to an upper part of the shoulder 40.

The gasket 41 is formed of NBR or foam PE to enhance the sealing strength of the container body 10.

The discharge pump BO for pumping the cosmetic content contained in the container body 10 is installed inside the shoulder 40.

The discharge pump 50 includes a piston 53, a cylinder 51 into which the piston 53 is inserted, a piston ring 54 installed between n outer peripheral surface of the piston 53 and an inner peripheral surface of the cylinder 51, a check valve 52 formed on a lower portion of the cylinder 51, a sealing member 55 coupled to an upper portion of the cylinder 51, an elevation member 57 coupled between the sealing member 55 and the piston 53, and an elastic member 56 formed between the elevation member 57 and the sealing member 55.

The cylinder 51 is coupled to an inside of the shoulder 40. The piston 53 fitted with the piston ring 54 moves up or down in the cylinder 51. A lower inlet 511 is formed on a lower part of the cylinder 51 such that the mixture of the first and second cosmetic contents is introduced therethrough and an air suction hole 512 is formed on a side surface of the cylinder 51.

A check valve 52 is installed into the lower inlet 511 of the cylinder 51 such that the cosmetic content introduced into the cylinder 51 is prevented from flowing backward to the container body 10.

A discharge tube 513 is coupled to the lower end of the lower inlet 511, through which the cosmetic contents contained in the container body 10 transfers to the cylinder 51.

The piston 53 is formed therein with a hollow 531. A blocking wall 534 is formed at a lower side of the hollow 531. An inlet 532 is formed on a side surface of the piston 53 to allow the cosmetic contents to introduce through the inlet 532. A flange 533 is formed on a lower end of the piston 53.

The elevation member 57 communicating through the hollow 531 is assembled to an upper part of the piston 53, such that the piston 53 move up or down as the elevation member 57 moves up or down.

The piston ring 54 is fitted on an outer peripheral surface of the piston 53 such that the piston ring 54 is disposed over the flange 533 of the piston 53.

Thus, as the piston 53 moves down, a gap is generated between the flange 533 of the piston 53 and the piston ring 54 to form a discharge passage. As the piston 53 moves up, the flange 533 of the piston 53 is tightly closed to the piston ring 54 so that the discharge passage is closed.

The cylinder 52 is fitted into the inside of the sealing member 55 and the upper cap 60 is coupled to the outside of the sealing member 55 to enhance the sealing strength of the container body 10.

The elastic member 56 is placed on the upper surface of the sealing member 55. The elastic member 56 is fitted with the outer peripheral surface of the elevation member 57 so that the elastic member 56 is interposed between the sealing member 55 and the elevation member 57, thereby elastically supporting the pumping operation of the elevation member 57.

The piston 53 is fitted Into the inside of the elevation member 57. The cosmetic contents discharged through the hollow 531 pass through the inside of the elevation member 57 to be discharged to the push button 70.

The upper cap 60 is coupled to the outer peripheral surface of the shoulder 40.

The upper cap 60 includes an inner cap 61 and an outer cap 62, where a fixing protrusion wheel 63 integrally extends from an inside of the inner cap 61.

The inner and outer caps 61 and 62 may be integrated with each other.

The fixing protrusion wheel 63 presses the sealing member 55 of the discharge pump 50, thereby fixing the discharge pump 50.

The push button 70 is coupled to the elevation member 57 of the discharge pump 50.

A discharge nozzle 71 is formed on one side of the push button 70 and the mixed cosmetic contents in the container body 10 are discharged, through the discharge nozzle 71.

The container lid 80 is coupled to the shoulder 40 such that the push button 70 is prevented from being exposed to an outside.

A method of assembling the two-liquid mixing container provided with a pressing pocket according to an embodiment of the present invention and a state of using the same will be described in detail as follows.

To assemble the two-liquid mixing container provided with a pressing pocket of the present invention, the second fixing member 12 to which the pressing pocket 20 is coupled is coupled to the lower part of the container body 10. The first fixing member 11 is coupled to the inside of the second fixing member 12. The discharge valve 14 for selectively opening or closing the outlet 13 is installed at the center of the inner side of the first fixing member 11.

In this case, the second cosmetic content is contained in the pressing pocket 20.

Then, the lower cap 30 is detachably coupled to the lower part of the container body 10.

In addition, according to another embodiment of the present invention, the push plate 31 may be formed on a bottom. The separation protecting protrusion wheel 32 may be formed on the outer peripheral surface of the push plate 31. The lower cap 30 from which the receiving protrusion wheel 33 extends may be coupled to the upper part of the separation protecting protrusion wheel 32.

After the coupling of the lower cap 30 is completed, the shoulder 40 is coupled to the upper part of the container body 10 and the first cosmetic content is injected into the container body 10.

After the discharge pump 50 is installed to the inside of the shoulder 40, the upper cap 60 is coupled to the outer peripheral surface of the shoulder 40 to fix the discharge pump 50.

After the push button 70 is coupled to the elevation member 57 of the discharge pump 50, the container lid 80 is coupled to the shoulder 40 to prevent the push button 70 from being exposed to an outside, so that the assembly is completed.

Differently from that of the related art, the structure of mixing the first and second cosmetic contents is simplified so that the two-liquid mixing container may be easily mass-produced, thereby reducing the manufacturing cost and the number of assembly processes airflow, and improving the productivity.

To use the two-liquid mixing container provided with a pressing pocket assembled in the method described above, as shown in FIG. 5, the lower cap 30 is separated from the container body 10. Then, as shown in FIG. 6, the second cosmetic content is transferred to the container body 10 by pressing the pressing pocket 20 containing the second cosmetic content such that the second cosmetic content is mixed with the first cosmetic content contained in the container body 10.

Thereafter, as shown in FIG. 7, the lower cap 30 is coupled to the container body 10.

Figure 12:
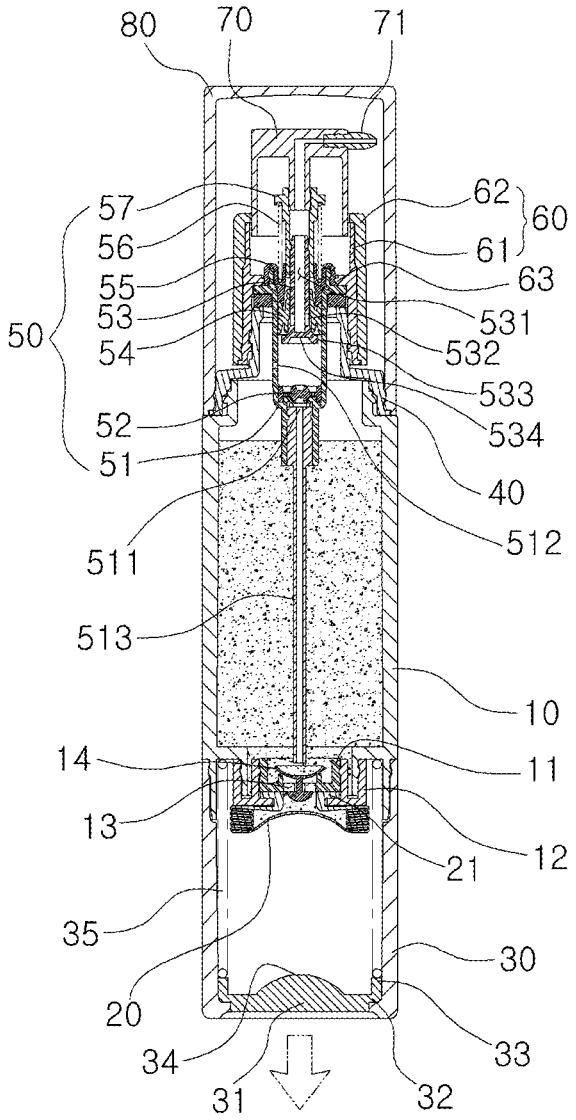
FIG. 12 is a sectional view illustrating a state of releasing a pressure on a push button of a two-liquid mixing container provided with a pressing pocket according to another embodiment of the present invention.

In addition, as shown in FIGS. 10 to 12, like another embodiment of the present invention, the push plate 31 may be formed on the bottom. The separation protecting protrusion wheel 32 may be formed on the outer peripheral surface of the push plate 31. The lower cap 30 from which the receiving protrusion wheel 33 extends may be coupled to the upper part of the separation protecting protrusion wheel 32. Thus, the second cosmetic content contained in the pressing pocket 20 may be transferred into the container body 10 by pushing the push plate 31 formed on the bottom of the lower cap 30.

Then, as shown in FIG. 8, when the push button 70 is pressed, the piston 53 of the discharge pump 50 is pressed downward. In this case, only the piston ring 54 fitted onto the outer peripheral surface of the piston 53 moves down in the stopped state due to the friction against the inner side wall of the cylinder 51, while a gap is formed between the flange 533 of the piston 53 and the piston ring 54, a passage through Which the mixed cosmetic contents in the container body 10 are discharged is generated.

Then, if the piston 53 is pressed downward, while the end of the elevation member 57 contacts the piston ring 54, the elevation member 57 moves down with the piston ring 54 so that the volume of the cylinder 51 is reduced.

Thus, the mixed cosmetic contents in the cylinder 51 is pressed so that the mixed cosmetic contents are discharged between the flange 533 of the piston 53 and the piston ring 54 and after passing through the inlet 532, are discharged through the hollow 531 and the push button 70 to an outside, so that the mixed cosmetic contents are used.

As shown in FIG. 9, after the cosmetic contents are discharged for use, when the pressure is removed from the push button 70, the push button 70 moves up by the elastic force of the elastic member 56, so that the gap between the flange 533 and the piston ring 54 is closed while the piston 53 moves up. Then, while the piston ring 54 moves up together with the piston 53, a vacuum pressure, is generated in the cylinder 51. Thus, while the check valve 52 is lifted up, the cosmetic contents are provided from the container body 10 to the cylinder through the lower inlet 511 and the discharge tube 513.

As described above, the two-liquid mixing container provided with a pressing pocket described in the present invention is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Container body
11: First fixing member
12: Second fixing member
13: Outlet
14: Discharge valve
20: Pressing pocket
21: Latch sill
30: Lower cap
31: Push plate
32: Separation protecting protrusion wheel
33: Receiving protrusion wheel
34: Push part
35: Lower cap elastic member
40: Shoulder
41: Gasket
50: Discharge pump
51: Cylinder
52: Check valve
53: Piston
54: Piston ring
55: Sealing member
56: Elastic member
57: Elevation member
60: Upper cap
61: Inner cap
62: Outer cap
63: Fixing protrusion wheel
70: Push button
71: Discharge nozzle
80: Container lid

The invention claimed is:

1. A two-liquid mixing container provided with a compressible pocket, the two-liquid mixing container comprising:

a container body (10) containing a first cosmetic content and having upper and lower parts opened;

the compressible pressing pocket (20) coupled to the lower part of the container body (10), wherein, in an unpressed state of the pressing pocket, the pressing pocket contains a second cosmetic content therein and, in a pressed state of the pressing pocket, the second cosmetic content is transferred to the container body from the pressing pocket;

a lower cap (30) covering an outside of the pressing pocket (20) and detachably attached to the lower part of the container body (10);

a shoulder (40) coupled to the upper part of the container body (10);

a discharge pump (50) installed inside the shoulder (40) to pump the first and the second cosmetic contents;

an upper cap (60) coupled to an outer peripheral surface of the shoulder (40);

a push button (70) installed to an upper end of the discharge pump (50) and formed on one side thereof with a discharge nozzle (71); and a container lid (80) detachably attached to the shoulder (40).

2. The two-liquid mixing container of claim 1, further comprising first and second fixing members (11 and 12) coupled to the lower part of the container body (10) for fixing the pressing pocket (20).

3. The two-liquid mixing container of claim 2, further comprising a discharge valve (14) installed at a center of an inside of the first fixing member (11) to selectively open or close an outlet (13) for the second cosmetic content.

4. The two-liquid mixing container of claim 1, further comprising a latch sill (21) formed on an upper end of the pressing pocket (20), wherein the latch sill (21) is fixedly inserted between the first and second fixing members (11 and 12).

5. The two-liquid mixing container of claim 1, wherein the pressing pocket (20) is formed of at least one of natural rubber, elastomer, silicone rubber, nitrile-butadiene rubber (NBR), and elastic synthetic material.

6. The two-liquid mixing container of claim 1, wherein the pressing pocket is formed in a bellows shape.

7. The two-liquid mixing container of claim 1, further comprising a push plate (31) movably formed on a bottom of the lower cap (30), a separation protecting protrusion wheel (32) formed on an outer peripheral surface of the push plate (31), and a receiving protrusion wheel (33) extending from an upper part of the separation protecting protrusion wheel (32).

8. The two-liquid mixing container of claim 7, further comprising a lower cap elastic member (35) installed between an inner upper end of the lower cap (30) and the receiving protrusion wheel (33) of the push plate (31).

9. The two-liquid mixing container of claim 1, wherein the discharge pump (50) includes a piston (53), a cylinder (51) into which the piston (53) is inserted, a piston ring (54) installed between an outer peripheral surface of the piston (53) and an inner peripheral surface of the cylinder (51), a check valve (52) formed on a lower part of the cylinder (51), a sealing member (55) coupled to an upper part of the cylinder (51), an elevation member (57) coupled between the sealing member (55) and the piston (53), and an elastic member (56) formed between the elevation member (57) and the sealing member (55).

10. The two-liquid mixing container of claim 1, wherein the upper cap (60) includes an inner cap (61) and an outer cap (62), and a fixing protrusion wheel (63) is integrally formed with an inside of the inner cap (61) while extending from the inside of the inner cap (61).

* * * * *